US008782898B2

(12) United States Patent
Heng

(10) Patent No.: US 8,782,898 B2
(45) Date of Patent: Jul. 22, 2014

(54) METHOD FOR TWISTING HOLLOW BARS

(76) Inventor: Kian Yong Heng, Singapore (SG)

( * ) Notice: Subject to any disclaimer, the term of this patent is extended or adjusted under 35 U.S.C. 154(b) by 65 days.

(21) Appl. No.: 13/003,710

(22) PCT Filed: Feb. 19, 2009

(86) PCT No.: PCT/SG2009/000059

§ 371 (c)(1),
(2), (4) Date: Jan. 11, 2011

(87) PCT Pub. No.: WO2010/096018

PCT Pub. Date: Aug. 26, 2010

(65) Prior Publication Data

US 2011/0293959 A1 Dec. 1, 2011

(51) Int. Cl.

| | |
|---|---|
| ***B21D 11/14*** | (2006.01) |
| ***B21D 47/00*** | (2006.01) |
| ***B23P 17/00*** | (2006.01) |

(52) U.S. Cl.

USPC ..... 29/897; 29/428; 29/505; 29/514; 29/897.3; 29/897.33; 428/592; 52/857; 52/843; 72/299; 72/371

(58) Field of Classification Search

USPC ..... 29/428, 505, 514, 897, 897.15, 897.3, 29/897.33; 428/592; 52/857, 843–845; 72/371, 299

See application file for complete search history.

(56) References Cited

U.S. PATENT DOCUMENTS

| | | | | |
|---|---|---|---|---|
| 2,420,715 | A * | 5/1947 | Millward | 138/116 |
| 2,454,640 | A * | 11/1948 | Eichner | 114/90 |
| 2,516,020 | A * | 7/1950 | Reed | 29/897 |
| 5,107,694 | A | 4/1992 | Kemp | 72/64 |
| 5,410,808 | A | 5/1995 | Geppelt et al. | 29/890.036 |
| 5,771,726 | A | 6/1998 | Bibby et al. | 72/20.2 |
| 6,189,359 | B1 | 2/2001 | Caporusso et al. | 72/299 |
| 6,286,281 | B1 * | 9/2001 | Johnson | 52/592.1 |
| 2006/0101890 | A1 | 5/2006 | Chung | 72/371 |

FOREIGN PATENT DOCUMENTS

| | | |
|---|---|---|
| JP | 55-165227 | 12/1980 |

OTHER PUBLICATIONS

International Search Report from PCT/SG2009/000059 dated May 4, 2009.

* cited by examiner

*Primary Examiner* — David P. Bryant
*Assistant Examiner* — Matthew P Travers
(74) *Attorney, Agent, or Firm* — Ohlandt, Greeley, Ruggiero & Perle, L.L.P.

(57) ABSTRACT

A method for fabricating a hollow bar that forms elements of a grille or railing of a metalwork piece where the bar is twisted manually, machine-assisted or automated machinery, into a spiral form for decorative or ornamental purposes. By providing the hollow bar to be comprised of separate longitudinal parts which may be hinged-joined to complementarily fastened to each other to form the hollow bar, the longitudinal joints are thus amenable to increased torsional stress, such that each of the parts may be twisted without breaching the material's fatigue limit and the bar as a whole capable of being twisted with more spiral turns within its elasticity limits. The twisted bar may thus be released for re-working for adjustments or re-installation. A number of exemplary joint embodiments, internal and external bracing accessories are also disclosed to cater for the different longitudinal part fabrication, e.g. by extrusion or roll-milling.

12 Claims, 13 Drawing Sheets

Figure 6
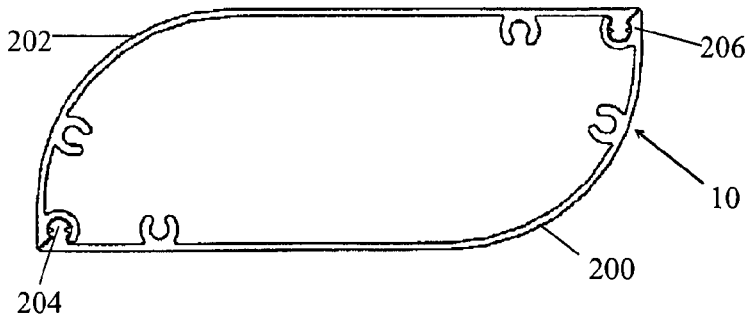
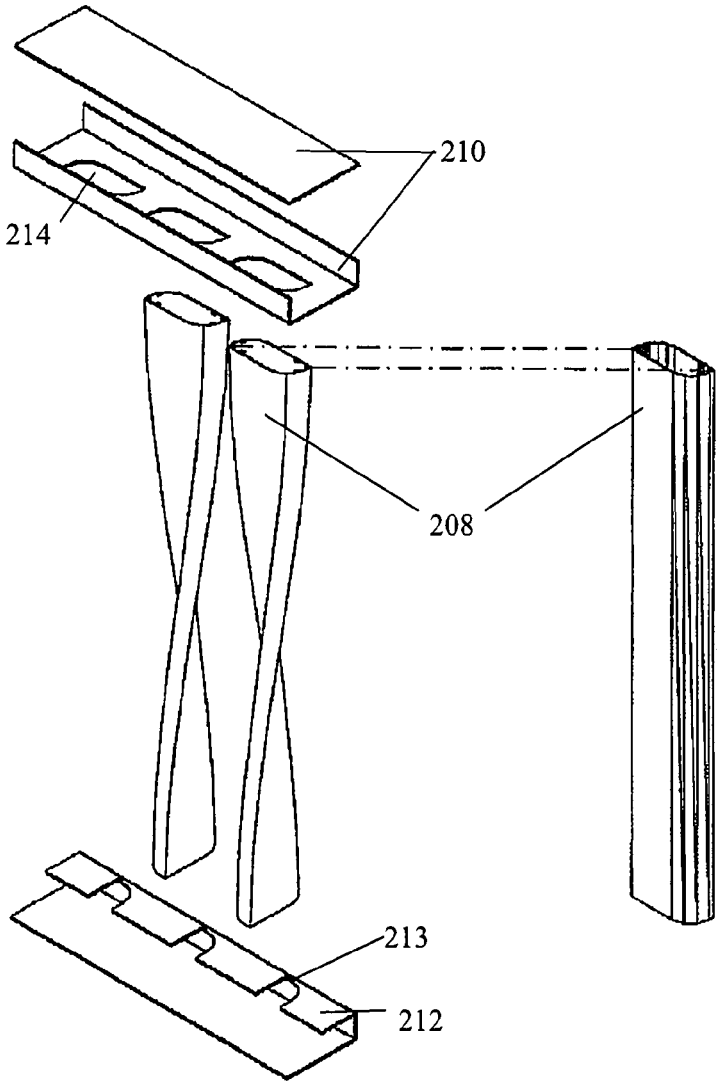
Figure 7

METHOD FOR TWISTING HOLLOW BARS

BACKGROUND

1. Field of the Disclosure

A method for twisting hollow bars into a desired longitudinal twisted spiral form is disclosed. The hollow bars may form part or all of a grille, railing, metalwork and like architectural element where the twisted spiral form may serve as decorative or ornamental purposes. A number of components or parts for use in respect of twisting the hollow bars are also disclosed.

2. Discussion of the Background Art

In addition to providing barrier purposes, the row of bars forming a grille, grating, divider, railing, and other metalwork pieces, openwork cover or barrier to doors and windows, louvre, lattice forms and the like architectural or furniture elements may be treated to improve upon its otherwise spartan barricading outlook. In particular, each of the bars may be purposely deformed, or so formed, into certain twisted pattern along its longitudinal axis resulting in a twisted or helical spiral for aesthetics or ornamentation.

An example of such twisting imparted to a bar or strip by an apparatus is disclosed in U.S. Pat. No. 5,107,694 (Kemp). As the strip of material or thin bar is solid, this prior art apparatus may use roll-milling to form the helical twists on the bar. Often it is not necessary for the bar to be solid in order to provide the necessary tensile strength such as that demonstrated by I-beam (or H-beam) cross-section. It is also known that while the flanges (horizontal elements) of the I-beam is very efficient in carrying both bending and shear in the plane of the web (vertical element), it is inefficient in carrying torsion for which hollow structural sections are preferred.

Methods for twisting hollow or tubular elements known in the art includes that disclosed in U.S. Pat. No. 5,410,808 (Geppelt et al.) for twisting a hollow double wall tube (i.e. bar having cylindrical cross-section). Prior art methods for twisting hollow rods having a rectangular cross-section, include U.S. Pat. No. 5,771,726 (Bibby et al.) which discloses a method and apparatus for twisting a hollow rod having open seam rectangular profile for use as curtain railing. Apart from the telescopic feature allowing the curtain rod to be lengthened with the same twisting aesthetics at the ends, this Bibby reference also mentions the problem of open-seam bars as having greater resilence to twisting due to the tendency of such bars to spring back partially or wholly to its untwisted state upon release from the twisting apparatus, or when the moment of force is removed, compared to close-seam or seam-less or tubular bars.

For tubular bars, the twisting is often irreversible and once twisted the material becomes permanently deformed once its elasticity point is breached. Any subsequent working on the bar would thus lead to material fatigue or material failure. It is thus desirable to maintain certain resilience in fabricating twisted bars so that the twisting may be reversed to a certain extent and re-twisted to adjust for fitting length, asthetics as well as without compromising tensile or structural strength and so that the bar being worked on need not be discarded if a slight workmanship error occurs or a small specification readjustment is required. Of course, it is well-known that material resilience and recovery from deformity depends on the material employed, such as whether the hollow bar is made of metal, alloy or polymers (including plastics) and its material properties such as its elasticity, torsional, shearing and tensile strengths, etc.

SUMMARY

We have in this disclosure endeavoured to provide for the fabrication of a hollow bar which configuration offers an increased resilience to torsional stress. Due to the resilience, we have also endeavoured to provide for various means and methods for twisting and bracing the twisted form of the bar depending on the nature of the material used to fabricate the hollow bar or its parts and components, e.g. whether the metal profile are extruded or the hollow bar part is profiled from metal sheets or strips that are stamped, pressed or bent to shape, roll-milled, extruded plastic profile, etc.

Our inventive concept is to provide separate longitudinal parts that may be assembled to comprise the hollow elongate member so that each of the parts may be twisted without breaching the material's fatigue limit. Upon releasing the twisting stress or removal of moment of force, the part may revert back to much of its original shape due to its material elasticity. Hence, in addition to increasing spiral turns for each hollow bar, one may release the twisted bar for reuse or re-twisting for adjustments or re-installation.

To these ends, our disclosure comprises of a method of longitudinally twisting a hollow elongate member to a desired spiral form comprising fabricating a plurality of longitudinal parts integral with joint means that are complementarily fastenable each other into forming the hollow elongate member. Upon fastening the plurality of longitudinal parts with the joint means to assemble the hollow elongate member, the assembled hollow elongate member is then twisted to the desired spiral form.

One feature of the disclosure is the presence of the joint means that accommodate limited pivotal movement due to moment of force arising from the twisting of the hollow elongate member. The joint means may be provided along the connecting edges of each of the longitudinal parts and thus enabling a continuous longitudinal joint. The joint means may be selected from any one or combination of tongue-in-groove type including hinge joint, ball-and-socket joint, pivot joint and uniaxial joint.

Another feature of the disclosure is that the longitudinal parts may be fabricated by any one or combination of extrusion and stamping, pressing, bending or roll-milling processes. Preferably, the hollow elongate member comprises a pair of identical longitudinal parts complementarily forming the hollow elongate member. Preferably still, the hollow elongate member has a cross-section profile selected from a polygon including any one of triangle, tetragon including rectangle, square, rhomboid, cuboid, parallelogram, ellipse, oval and the like.

One aspect of our disclosure is to provide bracing to maintain the hollow elongate member in the desired twisted spiral form. In one embodiment, the bracing includes integrally fabricating features with the longitudinal parts which features, upon assembly, forming internal bracing features within the hollow elongate member. Preferably, the internal bracing features include a sleeve formed by complementary semi-cylindrical halves integral with each of the longitudinal parts, wherein the semi-cylindrical halves may be joined to each other by sleeve joints. More preferably, a rod is insertable into the sleeve, and retaining pins transfixing the sleeve and rod at each ends of the hollow elongate member to keep the desired spiral form from unraveling.

In another embodiment, the bracing step includes providing a rod affixed with a plurality brace plates disposed therealong at suitable intervals and orientation to internally support the desired twisted spiral form of the hollow elongate member. The brace plate is preferably provided with a slot for insertion of the seam formed by the edges of roll-milled longitudinal parts.

Yet another embodiment of our bracing feature comprises providing end bracing means at each of the hollow elongate member's ends to keep the desired twisted spiral form from unraveling. Preferably, the end bracing means is provided in series for a row of hollow elongate members.

Products or parts thereof utilizing the above methods includes the aforedescribed longitudinal part, hollow elongate member, and a plurality of hollow elongate members twisted according the preceding methods, comprised wholly or part of a grille, grating, divider, railing, decorative or ornamental elements of a metalwork piece, openwork cover or barrier to doors and windows, louvre, lattice forms and the like architectural or furniture elements.

BRIEF DESCRIPTION OF THE DRAWINGS

Our disclosure may be understood with exemplary and non-limiting drawings with detailed description that follows wherein:

FIG. 6 shows a cross-sectional view of a third embodiment of hollow bar according to our disclosure;

FIG. 7 illustrates a fourth embodiment wherein external bracing means are employed to retain the twisted profile of the hollow bars;

DETAILED DESCRIPTION OF THE PREFERRED EMBODIMENT

For ease of description and avoidance of repetition, some of the terms employed in this specification may be used with the following meanings:

"hollow bar" may include hollow elongate member, tubular member and like shapes which may be employed as hollow bar elements of a railing, grille, grating and similar metalwork; and "twisting" includes action or force imparted to twist a hollow bar along its longitudinal axis to produce a twisted, spiral distortion of the bar, and "moment" or "moment of force" is to be interpreted as that imparted to the bar to result in such twisting or spiral distortion.

Figure 1:
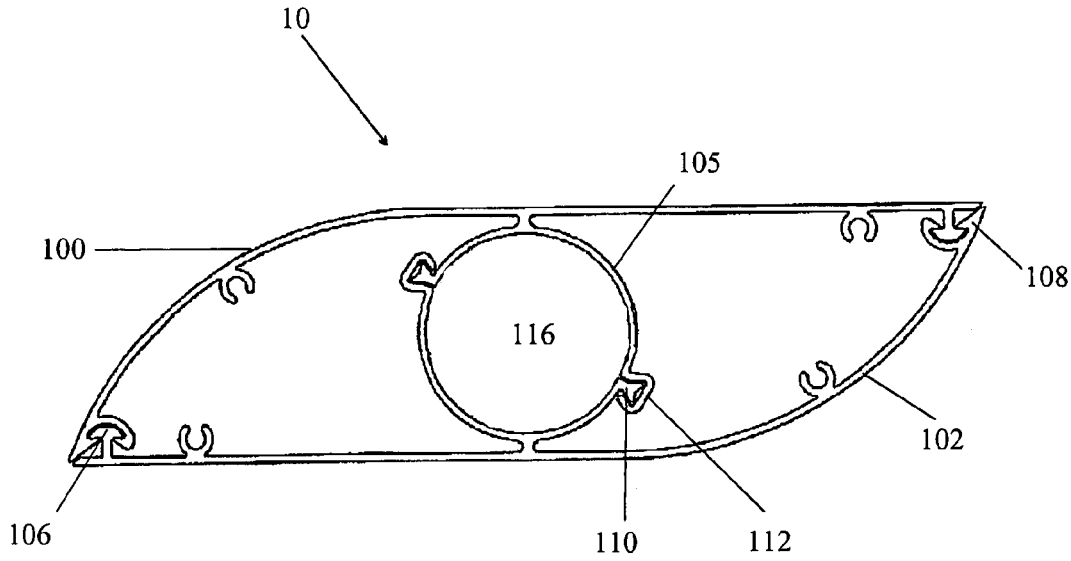
FIG. 1 shows a cross-sectional view of a first embodiment of hollow bar according to our disclosure.

To increase the hollow bar's resilience to torsional stress while the hollow bar is twisted to a desired spiral form, we have now proposed to fabricate the hollow bar, such as one exemplary one shown in cross-sectional view in FIG. 1, in a plurality of longitudinal parts (100, 102) which are complementarily fastenable to each other to form the complete hollow bar or elongate member (10). Each of the parts (100, 102) is fabricated joint means (106, 108) which may complementarily fasten onto the other part's joint means, whereby tying the longitudinal parts (100, 102) to form the complete hollow bar (10).

Each of the longitudinal parts (100, 102) may be fabricated by mass production (e.g. by roll-milling or extrusion) so that the mass-produced parts may then be assembled elsewhere using hand-operable machines or automated machines to slot in or snap-joint them into the hollow bar although the assembly may also be manually done. The completed hollow bar may also be twisted by hand or assisted by machine or operator-controlled, or by automated machine. For manual assembly and manual twisting, it is therefore possible for the longitudinal parts (100, 102) to be produced and sold as spare parts in hardware shops so that a DIY ("do-it-yourself") user may purchase them in small quantities to be cut to the desired lengths before slotting in or snapping in at the joints to complete the bar and manually twist it to the desired spiral form, together with other accessories to be described later.

Once the longitudinal parts (100, 102) are assembled and joined to form the hollow bar (10), the completed hollow bar (10) may then be twisted or applied with torsional stress to achieve the desired spiral form. Due to the multiple joints (106, 108) between the plurality of longitudinal parts (100, 102), limited pivotal movement is allowed at the joints or along the seams or joined edges of adjacent longitudinal parts to provide some stress relief from moment of force arising from the twisting. Thus, in this configuration, the hollow bar as a whole is able to withstand greater torsional stress without reaching material fatigue or permanent deformity.

Figure 12:
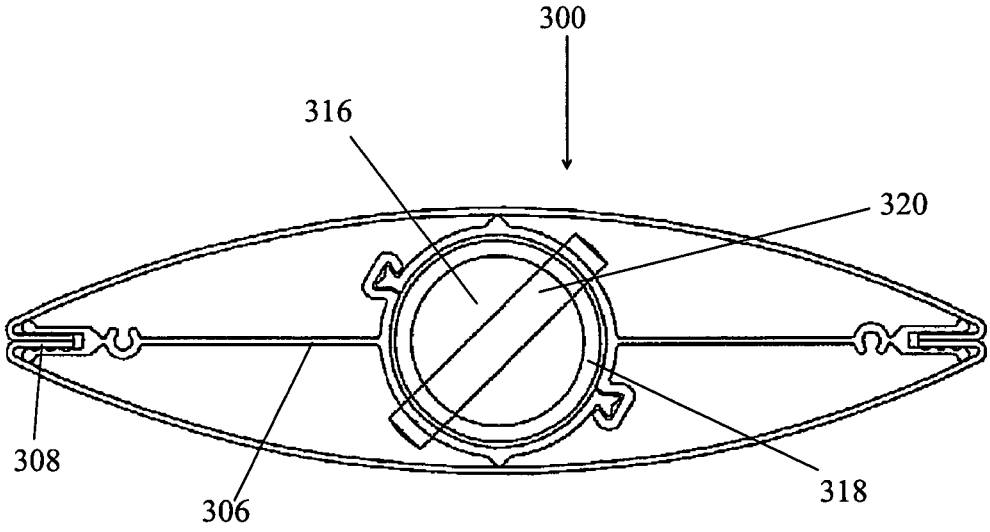
FIG. 12 exemplifies the sixth embodiment wherein internal bracing means are employed for retaining the twisted form.

The joint means (106, 108) may be selected from any one or combination of tongue-in-groove type including hinge joint, ball-and-socket joint, pivot joint and uniaxial joint. As apparent from the hinge joint such as that shown in FIG. 1 (106, 108), FIG. 3 (106, 108), FIG. 4 (106, 108), FIG. 5, (204, 206), FIG. 6 (204, 206), FIG. 9 or modified versions of the hinge joint in the form of seams being hemmed in or inserted into a strip of hemming slot (308) as shown in FIG. 10 and FIG. 12 and as (410) in FIG. 13 and FIG. 16.

As evident from the above description and drawings, the longitudinal parts may be fabricated by any one or combination of conventional extrusion, stamping, pressing, bending or roll-milling processes. For example, as shown in FIG. 10, the hollow bar may comprise of two longitudinal parts (301, 302) which have been formed by roll-milling process, and a bracing means which may be made by extrusion, disposed in the hollow part of the bar. In the example of FIG. 1, the bracing means may be formed integral with the longitudinal parts by extrusion.

For ease of fabrication and assembly, the longitudinal parts may be designed such that the plurality of the longitudinal parts are identical so that a plural number of the identical parts may be complementarily assembled to form the hollow bar. For example, the wavy parallelogram cross-section of the hollow bar of FIG. 1 may be formed by two identical longitudinal parts (100, 102) which also provides for complementary and integral extension into the hollow part of the completed bar to provide for internal bracing means. The cross-section profile of the hollow bar may be selected from a suitable polygonal profile for aesthetic purposes.

Examples of other polygonal profiles may include triangle, tetragon including rectangle, square, rhomboid, cuboid, parallelogram and circular profiles such as ellipse, oval and like shapes. Although increasing the number of longitudinal parts may increase the flexibility and resilience of the hollow bar to twisting, it is best to limit the number to two parts for ease of fabrication and assembly.

As have been introduced in the above, some form of bracing to maintain the hollow bar in its rectangular and twisted form may preferably be provided to prevent collapse and unraveling of the twisted or spiral form. Exemplary of these bracing—both internal bracing and external bracing are to be described in the following with reference to the drawings.

As previously described, FIG. 1 shows a hollow bar (10) with a parallelogram-like cross-section comprising 2 identical longitudinal parts (100, 102) which may be joined to each other along the longitudinal edges by hinge joint means (106, 108). In this embodiment, internal bracing means is provided in the form of semi-cylindrical halves or semi-cylindrical wall 105 integrally linked to the inner surface of longitudinal parts by tie wings. Each of the edges of the semi-cylindrical wall 105 may be formed with sleeve joints which may be tongue-and-groove joint means (110, 112) that complementarily joins to form a sleeve or cylindrical tube (116).

Figure 2:
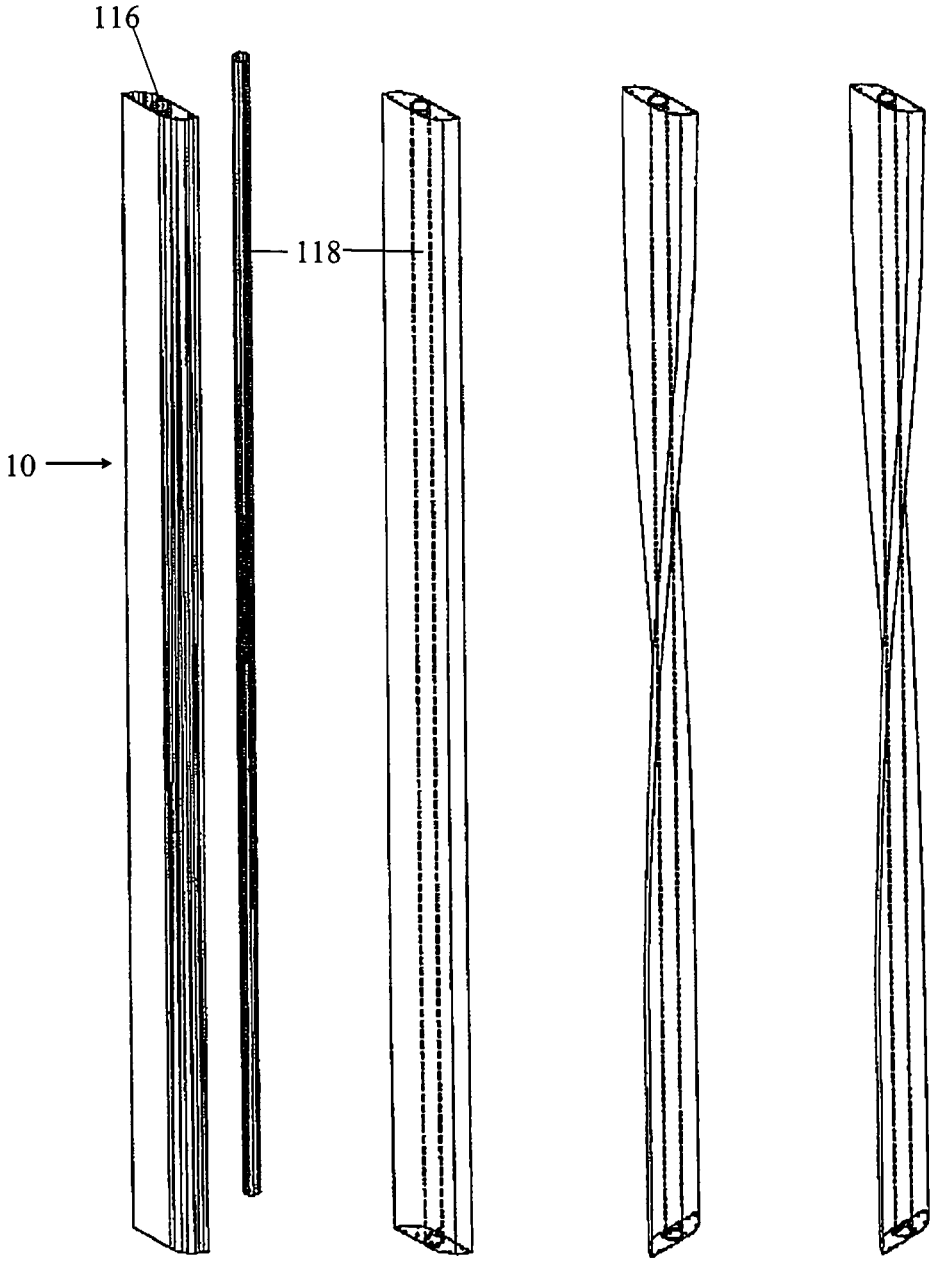
FIG. 2 illustrates a second embodiment in outline perspective views of various stages of a hollow bar being braced and twisted.
Figure 3:
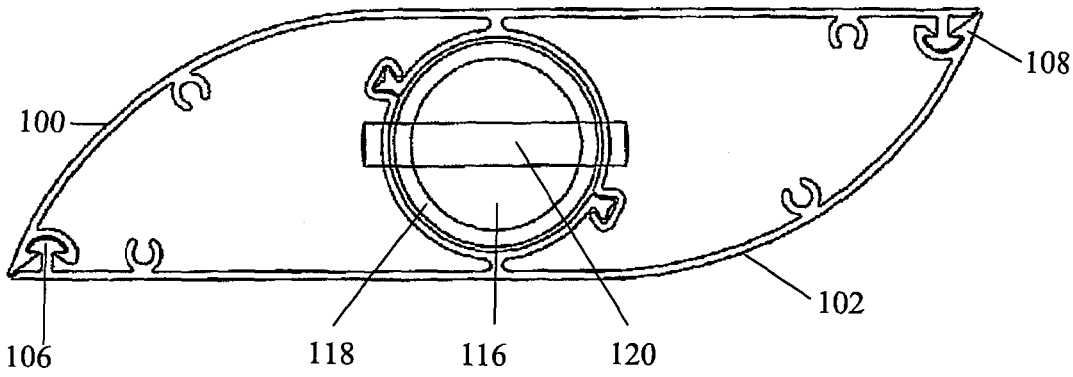
FIG. 3 exemplifies a cross-sectional view of the second embodiment with retaining means.

FIG. 2 shows in series how a rod (118) may be inserted into the cylindrical tube (116) formed before the hollow bar is twisted to the desired spiral form. To retain the spiral or to prevent the twisting from unspiraling, retaining pins (120) may be used to transfix the sleeve (116) and rod (118) at each ends of the bar (10) as shown in FIG. 3.

Figure 4:
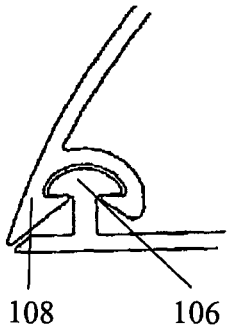
FIG. 4 and FIG. 5 depict 2 alternative joint means in the assembly of hollow bar according to our disclosure.
Figure 5:
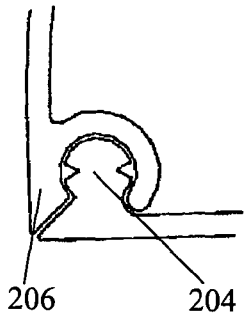

Many variations of the hinge joint may be used such as that shown in FIG. 4 and FIG. 5 which are basically variations of the tongue-in-groove type. An application of the joint type shown in FIG. 5 is used in the longitudinal parts (200, 202) shown in FIG. 6 which hollow bar does not include any internal bracing means. Instead, external bracing means in the form of end frames (210, 212) are used to retain the ends of the twisted hollow bar (208) to prevent the unraveling of its spiral form. The end frames may either be one or combination of a hole-slot (214) type as shown for the upper end frame (210) or the cut-out or notch (213) type as shown for the lower end frame (212) wherein the notch or cut-out on the end frame enables a width section of the hollow bar to be inserted thereinto. As further shown in FIG. 7, a series of such holes or slots (214) and/or notches (213) may be provided along the end frames to retain a row of twisted hollow bars (208).

Figure 8:
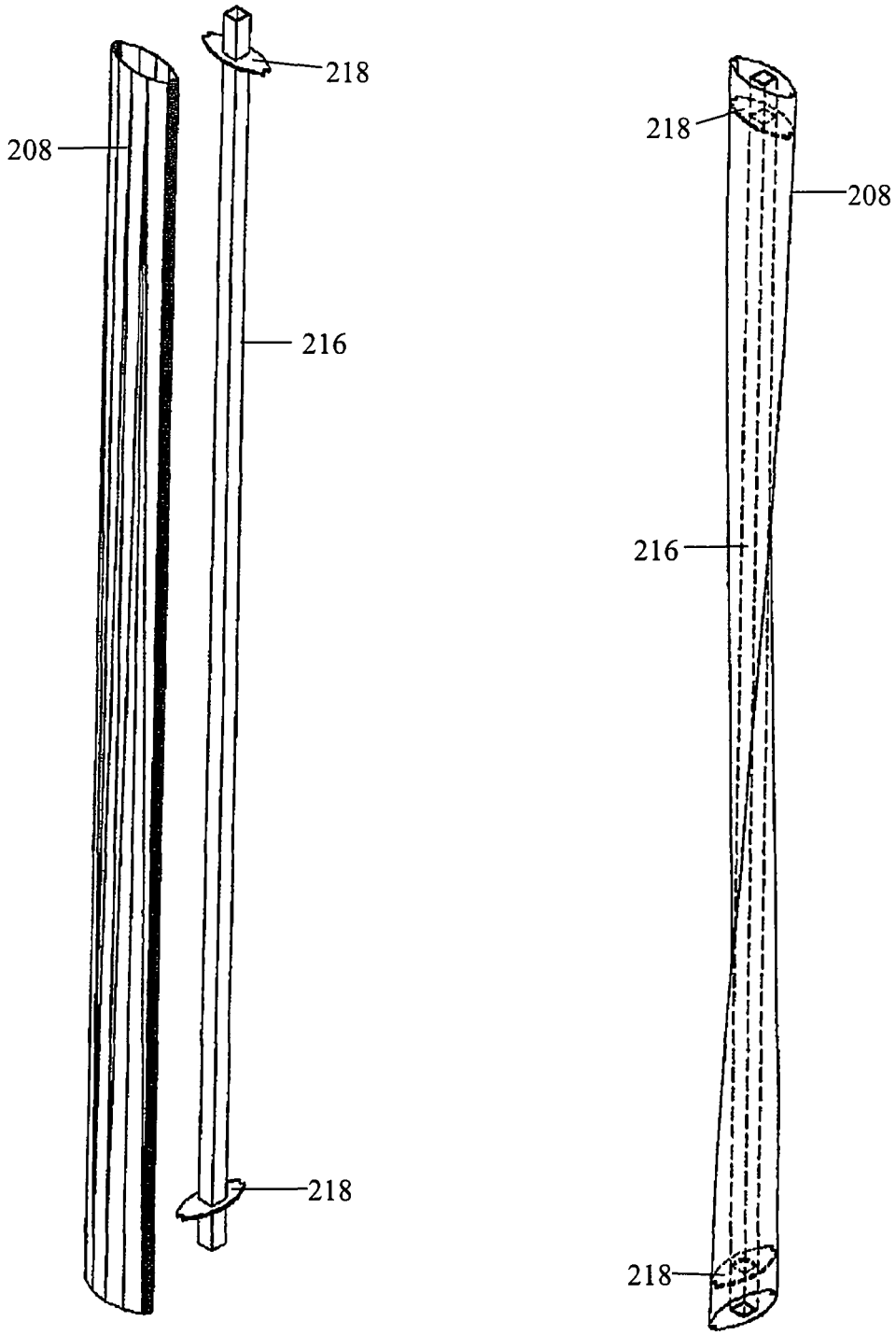
FIG. 8 exemplifies a fifth embodiment wherein internal bracing means are employed for the same purpose.
Figure 9:
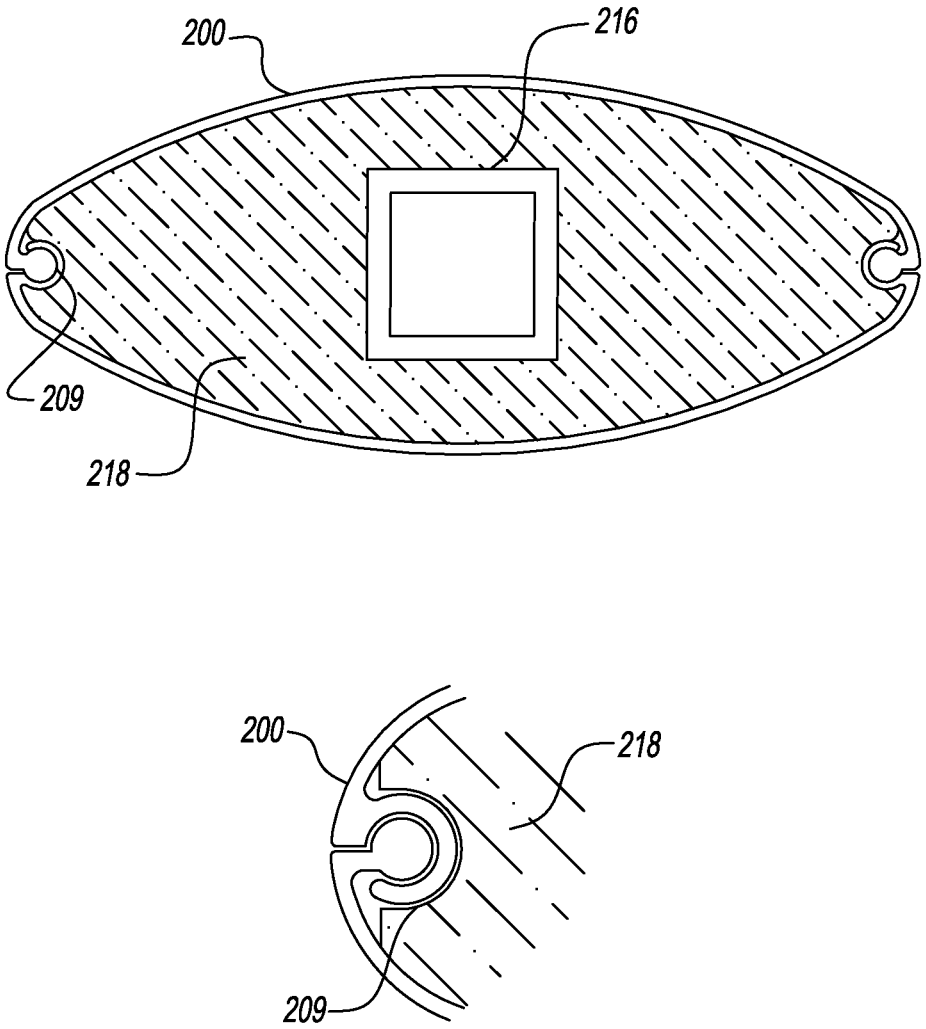
FIG. 9 depicts the cross-sectional view of the embodiment of FIG. 8 and details of a joint thereof.
Figure 10:
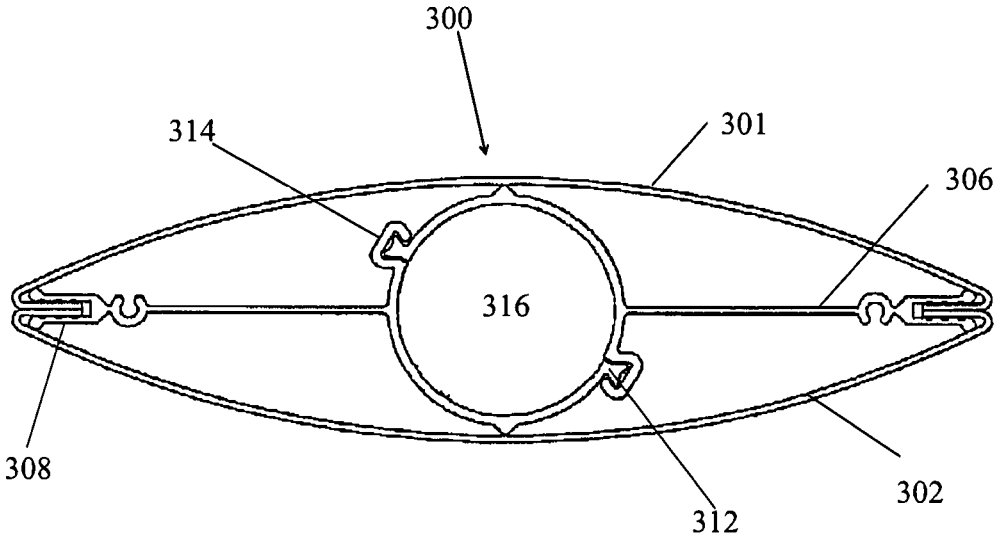
FIG. 10 shows a sixth embodiment of hollow bar according to our disclosure.

Another embodiment of internal bracing is shown in FIG. 8 and FIG. 9 wherein, instead of a rod inserted through a sleeve formed integrally with the longitudinal parts, a tube having a rectangular cross-section (216) is used. Instead of the integral sleeve, brace plates (218) are used whereby an aperture corresponding to the cross-section of the rectangular tube (216) is provided to enable the tube to be inserted through the brace plate (218). The brace plate (218) may be so inserted with its orientation to suit the twisted hollow bar at the point of insertion as shown in FIG. 8. A cross-sectional view of the plate's (218) insertion is shown in FIG. 9 and a detailed view of the plate's (218) tips being adapted to accommodate the joint and inside corners of the hollow bar around the joint (209). In this way, the brace plate (218) is able to provide a snug fit in the hollow section of the bar against the rectangular tube (216) and effectively retain the twisted form of the bar. Depending on the degree of twisting required and the resilience of the material used in fabricating the longitudinal parts, more than 2 brace plates (218) may be employed in suitable orientations along the spiral form of the rectangular tube (216).

For roll-milled hollow bar (300), the longitudinal parts (301, 302) may be fabricated by stamping, bending or pressing, roll-milling means but it will need internal parts to assist in joining the edges of the longitudinal parts (301, 302) such as that shown in FIG. 10. Depending on the internal bracing required, the internal part (306) may be fabricated of the same material as the longitudinal parts (301, 302) or of a different material, and may be fabricated by extrusion or moulding.

Figure 13:
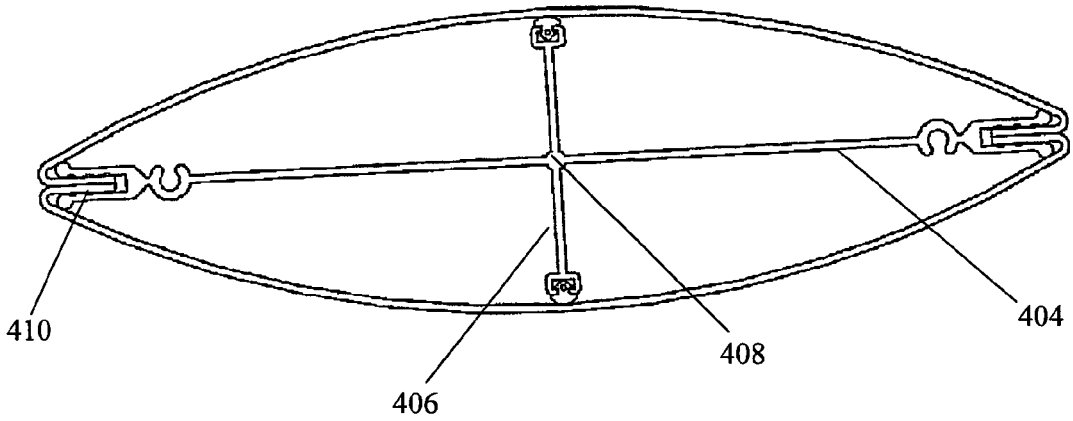
FIG. 13 depicts a seventh embodiment wherein internal bracing means for maintain cross-sectional profile instead of twist retaining purposes.

The internal part (306) may comprise of hemming slots (308) whereby the edges of the longitudinal parts (301, 302) may be hemmed in to form a seamed joint. In the most basic configuration two strips of hemming slots (308) may be provided to complete the joining of the longitudinal parts (301, 302) to form the complete hollow bar. In FIG. 13, the hemming slots (410) may be linked via internal webbing (408) comprising width rib (404) to each other, as well as cross-linked to thickness rib (406) which serves to maintain the thickness of the hollow bar as it is twisted.

A further preferred feature of internal part (306) is shown in FIG. 10 wherein internal bracing means is provided in the form of semi-cylindrical halves or semi-cylindrical wall integrally linked to the inner surface of longitudinal parts by tie wings similar to that described in FIG. 1. Each of the edges of the semi-cylindrical wall may be formed with sleeve joints which may be tongue-and-groove joint means (312, 314) that complementarily joins to form a sleeve or cylindrical tube (316).

Figure 11:
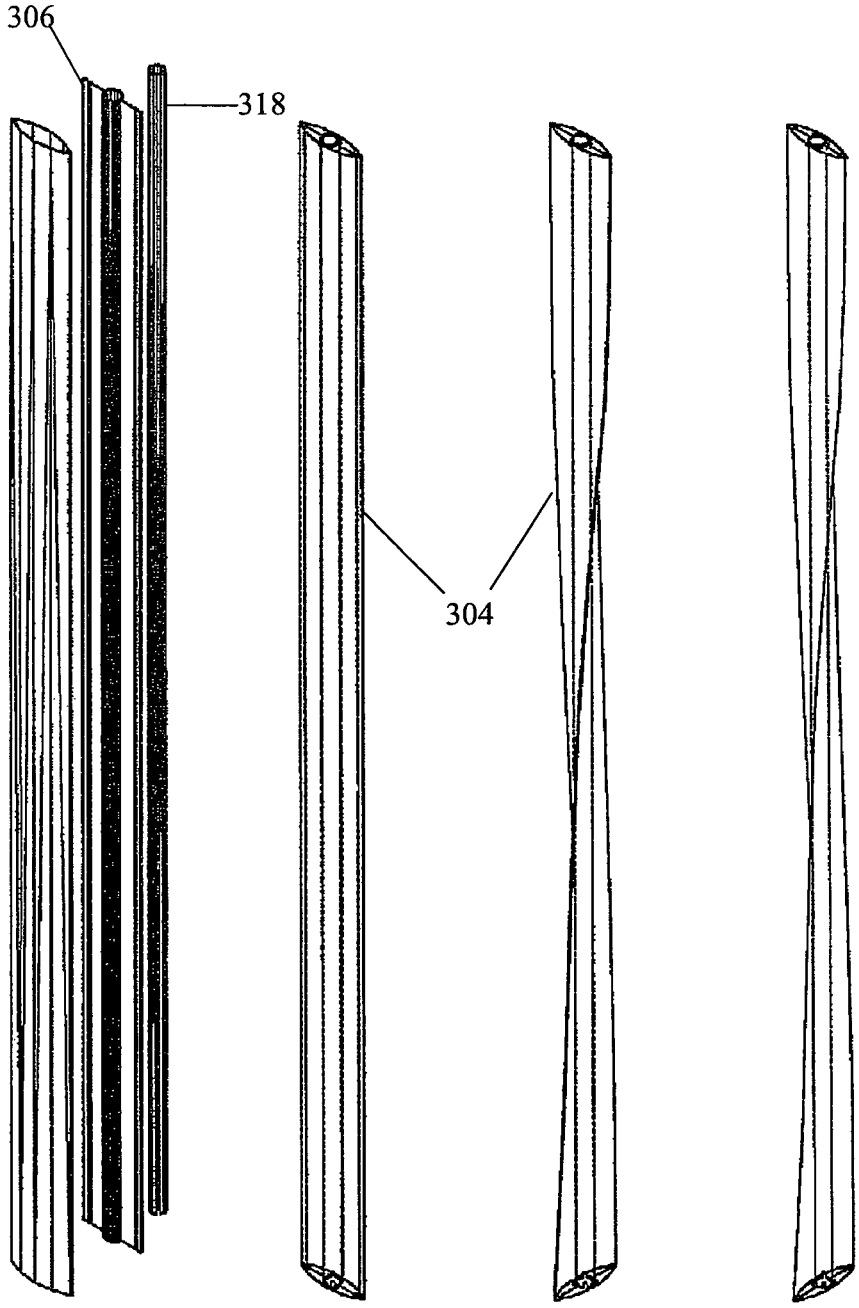
FIG. 11 illustrates the sixth embodiment in outline perspective views of various stages of a hollow bar being reinforced and twisted.
Figure 14:
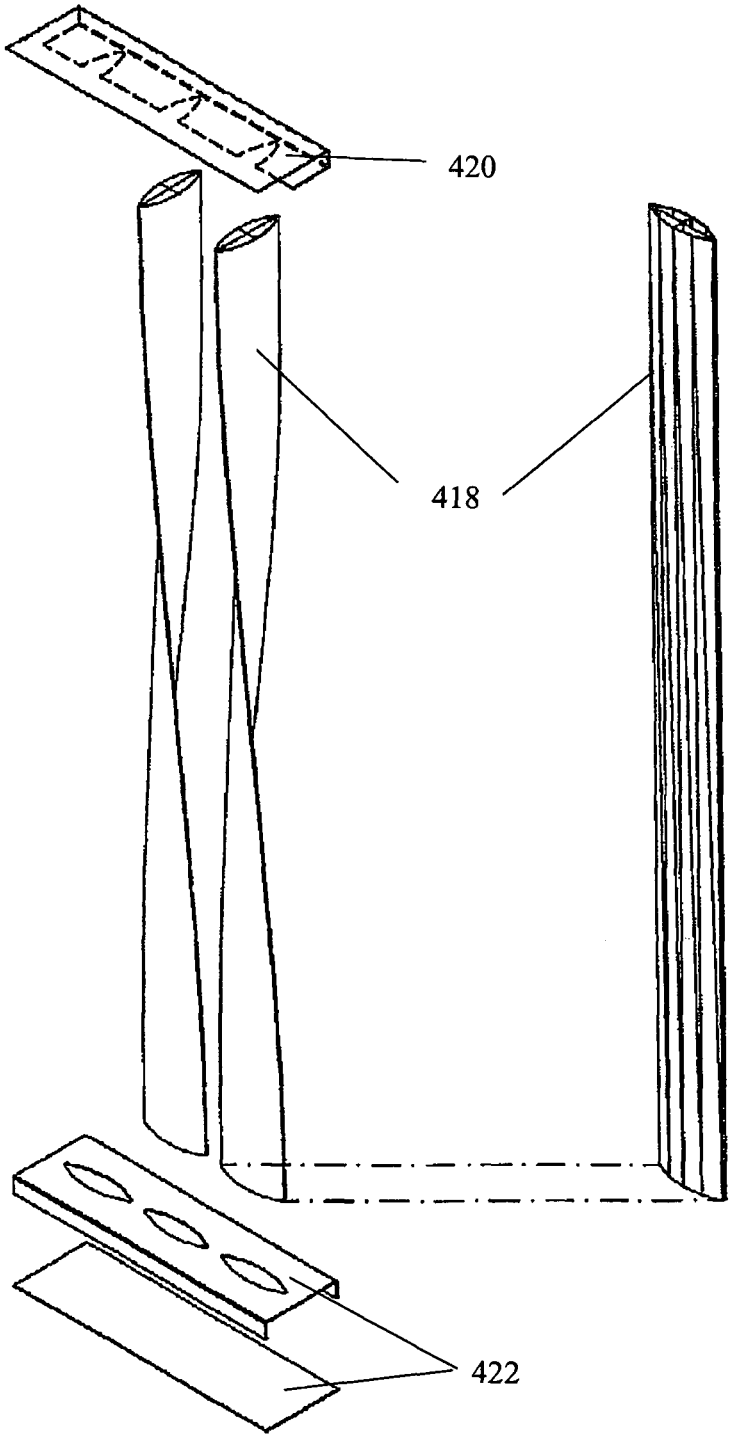
FIG. 14 shows the seventh embodiment being retained by external bracing means.

FIG. 11 shows a series of illustrations how a rod (318) may be inserted into the cylindrical tube (316) formed before the hollow bar (304) formed from roll-milled longitudinal parts (301, 302) is twisted to the desired spiral form. To retain the spiral or to prevent the twisting from unspiraling, retaining pins (320) may be used to transfix the sleeve (316) and rod (318) at each ends of the sleeve (316) as shown in FIG. 12. External bracing means (420, 422) may similarly be provided to retain the twisted hollow bars (418) as shown in FIG. 14, just as described in respect of FIG. 7 above.

Figure 15:
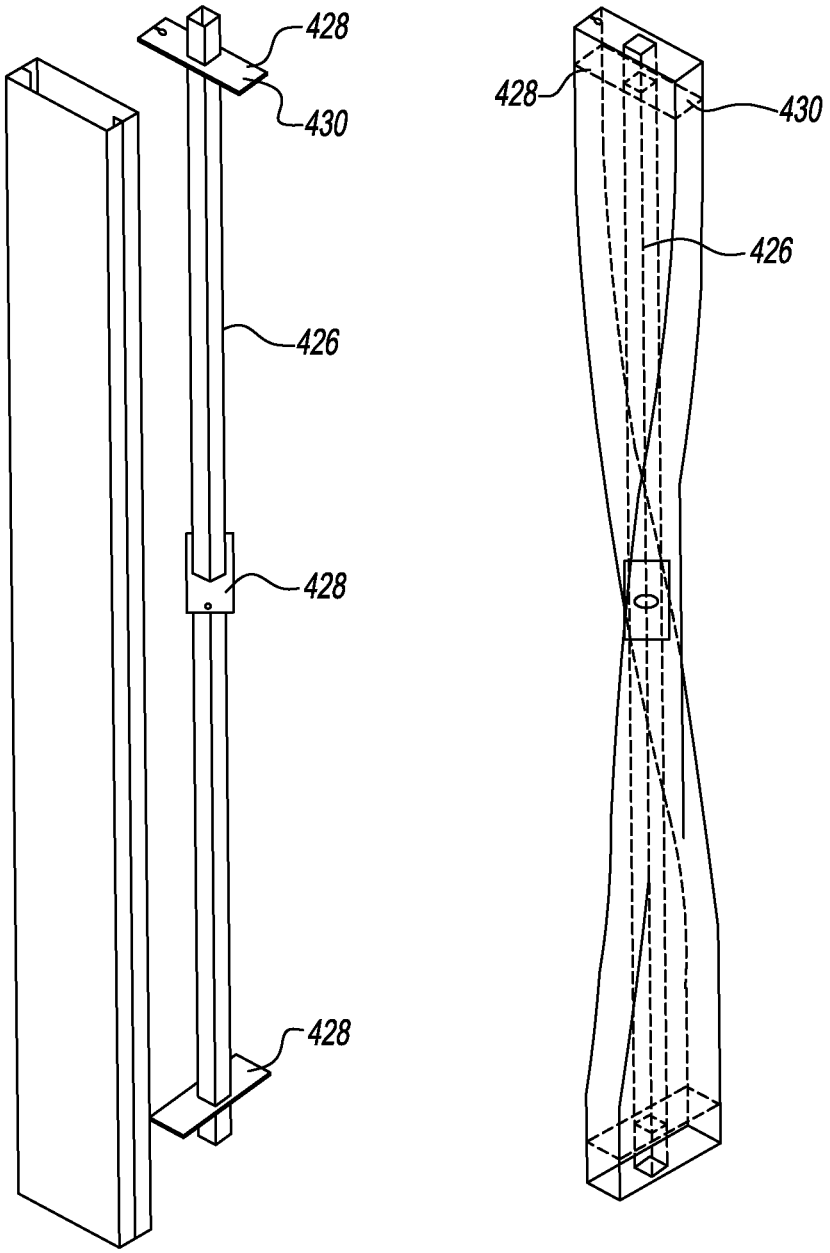
FIG. 15 illustrates an eight embodiment wherein internal bracing means are employed for retaining the twisted profile of the hollow bar.
Figure 16:
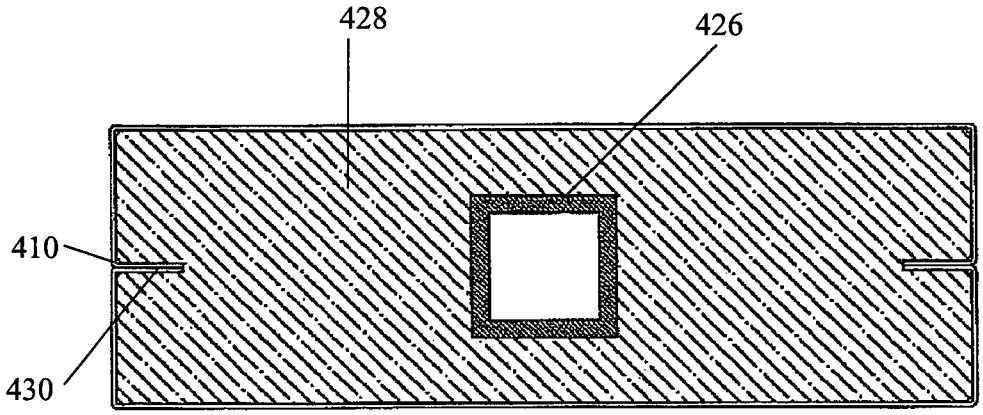
FIG. 16 exemplifies a cross-sectional view of the eight embodiment with internal bracing means.

FIG. 15 and FIG. 16 illustrate another embodiment of hollow bar formed from roll-milled longitudinal parts wherein a pair of such parts are shown joined to each other with the seams hemmed in. Internal bracing is provided in the form of a rod (426) having rectangular cross-section and a plurality of brace plates (428) with suitable aperture allowing the rod therethrough and disposed therealong at orientations to suit the twisted spiral form of the hollow bar as shown in FIG. 15. To cater for the hemmed seams of the hollow bar, cuts (430) are provided on the ends of the brace plate (428).

It should be noted that the foregoing description and drawings merely describe selected embodiments of the many possible variations of the hollow bar configuration, as well as the internal and external bracing means depending on the length and profile of the hollow bar, number of longitudinal parts forming the bar, the array of bars forming the railing, grille, grating and the like. Apart from these other possible embodiments, many of the present embodiments' features described above are also amenable to modification, substitution, and improvement without departing from the disclosure's essence and working principle. Such modifications are to be considered as falling within the letter and scope of the following claims.

The invention claimed is:

1. A method of longitudinally twisting a hollow elongate member to a desired spiral form comprising:

(a) fabricating a plurality of longitudinal parts integral with joint means complementarily fastenable to each other into forming said hollow elongate member;

(b) fastening said plurality of longitudinal parts with said joint means to assemble said hollow elongate member;

(c) twisting said assembled hollow elongate member to said desired spiral form; and (d) bracing to maintain the hollow elongated member in the desired twisted spiral form, wherein the bracing step includes integrally fabricating features with the longitudinal parts which features, upon assembly, form internal bracing features within the hollow elongate member, wherein the internal bracing features include a sleeve formed by complementary semi-cylindrical halves integral with each of the longitudinal parts, and wherein said semi-cylindrical halves are joinable to each other by sleeve joints.

2. The method according to claim 1 wherein the joint means accommodate limited pivotal movement due to moment of force arising from the twisting.

3. The method according to claim 1 wherein the joint means are provided along the connecting edges of each of the longitudinal parts enabling a continuous longitudinal joint.

4. The method according to claim 1 wherein the joint means are selected from any one or combination of tongue-in-groove type including hinge joint, ball-and-socket joint, pivot joint and uniaxial joint.

5. The method according to claim 1 wherein the longitudinal parts are fabricated by any one or combination of extrusion, roll-milling, stamping, pressing or bending processes.

6. The method according to claim 1 wherein the hollow elongate member comprises a pair of identical longitudinal parts complementarily forming said hollow elongate member.

7. The method according to claim 1 wherein the hollow elongate member has a cross-sectional profile selected from the group consisting of triangle, rectangle, square, rhomboid, cuboid, parallelogram, ellipse, and oval.

8. The method according to claim 1 further comprising inserting a rod into the sleeve and transfixing said sleeve and rod with retaining pins at each ends of the hollow elongate member to keep the desired spiral form from unraveling.

9. The method according to claim 1 wherein the bracing step includes providing a rod affixed with a plurality brace plates disposed therealong at suitable intervals and orientation to internally support the desired twisted spiral form of the hollow elongate member.

10. The method according to claim 9 wherein the brace plates are provided with slots for insertion of the seam formed by the edges of roll-milled longitudinal parts.

11. A method according to claim 1 wherein the bracing step comprises providing end bracing means at each of the hollow elongate member's ends to keep the desired twisted spiral form from unraveling.

12. A method according to claim 11 wherein the end bracing means is provided in series for a row of hollow elongate members.

* * * * *